US006655066B2

(12) United States Patent
Fluhr

(10) Patent No.: US 6,655,066 B2
(45) Date of Patent: Dec. 2, 2003

(54) MAGAZINE SAFETY UNITS FOR A SELF-LOADING FIREARM

(75) Inventor: Norbert Fluhr, Oberndorf (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 0 days.

(21) Appl. No.: 10/174,929

(22) Filed: Jun. 19, 2002

(65) Prior Publication Data

US 2002/0152660 A1 Oct. 24, 2002

Related U.S. Application Data

(63) Continuation of application No. PCT/EP01/12253, filed on Oct. 23, 2001.

(30) Foreign Application Priority Data

Oct. 23, 2000 (DE) ..... 100 52 468
Oct. 9, 2001 (DE) ..... 101 49 796

(51) Int. Cl.[7] ..... F41A 17/36
(52) U.S. Cl. ..... 42/70.02; 42/70.06
(58) Field of Search ..... 42/70.02, 70.05, 42/70.06

(56) References Cited

U.S. PATENT DOCUMENTS

| | | | | | |
|---|---|---|---|---|---|
| 2,372,519 | A | * | 3/1945 | Roper | 42/70.02 |
| 2,468,784 | A | | 5/1949 | Seagraves | 89/195 |
| 3,415,000 | A | * | 12/1968 | Koucky et al. | 42/70.02 |
| 3,715,826 | A | * | 2/1973 | Seifried | 42/70.02 |
| 3,962,809 | A | | 6/1976 | Lee | 42/66 |
| 4,031,648 | A | | 6/1977 | Thomas | 42/70 A |
| 4,352,317 | A | | 10/1982 | Wilhelm | 89/154 |
| 4,399,628 | A | | 8/1983 | Franchi et al. | 42/42 R |
| 5,225,612 | A | * | 7/1993 | Bernkrant | 42/70.02 |
| 5,355,768 | A | | 10/1994 | Felk | 89/147 |
| 5,438,784 | A | * | 8/1995 | Lenkarski et al. | 42/70.05 |
| 6,253,479 | B1 | * | 7/2001 | Fuchs et al. | 42/70.01 |

FOREIGN PATENT DOCUMENTS

| | | | | |
|---|---|---|---|---|
| AT | 133 977 | * | 6/1933 | 42/70.02 |
| DE | 506 923 | * | 9/1930 | 42/70.02 |
| FR | 571.503 | | 5/1924 | |
| FR | 722.555 | | 3/1932 | |
| FR | 751.009 | | 8/1933 | |
| FR | 802 583 | * | 9/1936 | 42/70.02 |
| FR | 804 981 | * | 11/1936 | 42/70.02 |
| GB | 2468 | * | of 1914 | 42/70.02 |
| GB | 151 196 | * | 9/1920 | 42/70.02 |

OTHER PUBLICATIONS

International Preliminary Examination Report for PCT/EP00/11888 dated Feb. 11, 2002.

*International Search Report* corresponding to International Patent Application Serial No. PCT/EP01/12253, European Patent Office, Dated Feb. 15, 2002, 3 Pages.

*International Preliminary Examination Report* corresponding to International Patent Application Serial No. PCT/EP00/11888, European Patent Office, Dated Feb. 11, 2002, 10 Pages.

*International Search Report* corresponding to International Patent Application Serial No. PCT/EP00/11888, European Patent Office, Dated Feb. 27, 2001, 6 Pages.

* cited by examiner

*Primary Examiner*—Stephen M. Johnson
(74) *Attorney, Agent, or Firm*—Grossman & Flight, LLC

(57) ABSTRACT

Magazine safety units for use in a self-loading firearm with a removable magazine are disclosed. An example safety unit includes a swiveling lever which is held by a spring in the movement path of a bar which is connected with a trigger. The lever engages the bar in an impeding manner. Engagement of the lever with a part of the magazine swivels the lever out of engagement with the bar.

17 Claims, 3 Drawing Sheets

MAGAZINE SAFETY UNITS FOR A SELF-LOADING FIREARM

RELATED APPLICATION

This patent arises from a continuation of International Application Ser. No. PCT/EP01/12253, filed Oct. 23, 2001.

FIELD OF THE DISCLOSURE

This disclosure relates generally to firearms and, more particularly, to magazine safety units for a self-loading firearm.

BACKGROUND

All of the positional statements used in this document assume a firearm that is located in its normal firing position. The barrel is horizontally oriented, pointing away from the shooter, and the magazine extends more or less obliquely to the barrel from bottom to top.

The typical magazine has two lateral surfaces positioned opposite to one another which end, at the top and rear, in magazine lip units. In front of the magazine lip units, the magazine is sloped downwardly, so that cartridges can thereby be slid to the front between the magazine lip units without being impeded.

The forward surface of the magazine is often angled, but is not completely applied to the contour of the firearm, however, so that it is not, to the extent possible, abraded. As a general rule, a certain clearance is, thus, present between the bullet and the wall of the magazine. This is particularly true for magazines that provide staggered storage of cartridges.

Magazine safety devices have been known for a long time and have the primary task of making shooting impossible if the magazine has been removed from the weapon. Many varied constructions of such devices are known. For example, in pistols such as the S&W Mod. 559, the lock can be moved back and the hammer can be cocked even if the magazine has been removed, but not by means of the trigger. A magazine safety unit is also known from U.S. Pat. No. 4,031,648.

Modern pistols have a plastic pistol grip. The pistol stock is integrally formed with the pistol grip and cannot be removed. By virtue of this approach, the internal parts of the weapon are not accessible, but no parts can be mounted if the pistol stock has been removed.

The applicant has recently proposed a magazine safety unit which is attached backwardly to the lower end of the shaft of the magazine and has a finger unit which is biased by a spring in the shaft of the magazine. If this finger unit is pressed back by the magazine, then the mechanism of the weapon remains unaffected. If the magazine is removed, however, then a part cooperating with a pin impedes a spring bar around which the striking spring is placed when the hammer is relaxed. This prevents movement of this spring bar thereby clamping the hammer. It also prevents the loading movement, prevents disassembly of the weapon, and prevents shooting of the weapon.

The fact that the magazine must be practically entirely removed in order to activate the magazine safety unit is disadvantageous, however. It is thus not possible for the shooter to be made aware, by way of the magazine safety unit, of the fact that the magazine has not been completely inserted and engaged.

On the other hand, a magazine safety unit with a swiveling lever, which is swivelable around the axis of the trigger and engages with the bar from the front, has already been presented in U.S. Pat. No. 5,355,768. This swiveling lever is stressed by pulling of the trigger and can be bent upwardly if the trigger has been forcefully activated with the magazine removed.

In certain hammer lock constructions, the hammer is also blocked with the bar. Then, with the hammer blocked, the sliding support of the pistol cannot be drawn back far enough to draw a cartridge out of the cartridge storage unit. If the magazine is removed with the pistol loaded, it is not possible to unload the weapon.

It is usual in military and civil guard units, such as during the changing of the guard, for example, to first remove the magazine and to then hand the unloaded weapon and the full magazine over to the incoming guard shift. This is not possible in the case of weapons of the type stated above, because the weapon cannot be reloaded after the removal of the magazine. It is not possible to unload the reloaded weapon without the magazine. The removed magazine could be emptied, the empty magazine could then be inserted into the weapon, and this could subsequently be unloaded. During years of use, however, guard personnel have tended to somewhat neglect safety out of shear laziness.

DESCRIPTION OF THE PREFERRED EXAMPLES

Figure 1:
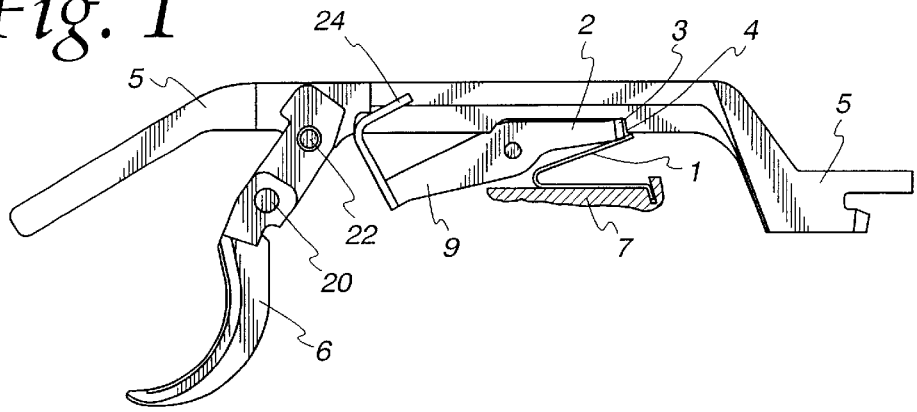
FIG. 1 is an illustration of part of an exemplary trigger device of a self-loading firearm including an example magazine safety unit in the secured position.

In the example of FIG. 1, a trigger (6) extends upwardly. Two rotation points (20, 22) are formed near its top. The lower one of the rotation points (20, 22) is seated on a lateral axis in the pistol grip. The upper one of the rotation points (20, 22) is seated on a lateral axis which is attached to a bar (5). If the trigger (6) is pulled (that is to say, pressed to the right in FIG. 1), then it swivels around the lower, stationary rotation point (20) and pulls the bar (5) to the front (i.e., to the left in FIG. 1).

The bar (5) extends to the front (to the left in FIG. 1) when it cooperates with a conventional safety device (not shown) which, when actuated, prevents movement of the bar (5) to the front (i.e., to the left in FIG. 1).

On the rear (right) end, the bar (5) engages with a conventional hammer (not shown), either directly or indirectly, in order to clamp and to pull the hammer. As is evident from FIG. 2, the bar (5) is extended to the right over a magazine opening, which is sized to receive a magazine (8).

Figure 2:
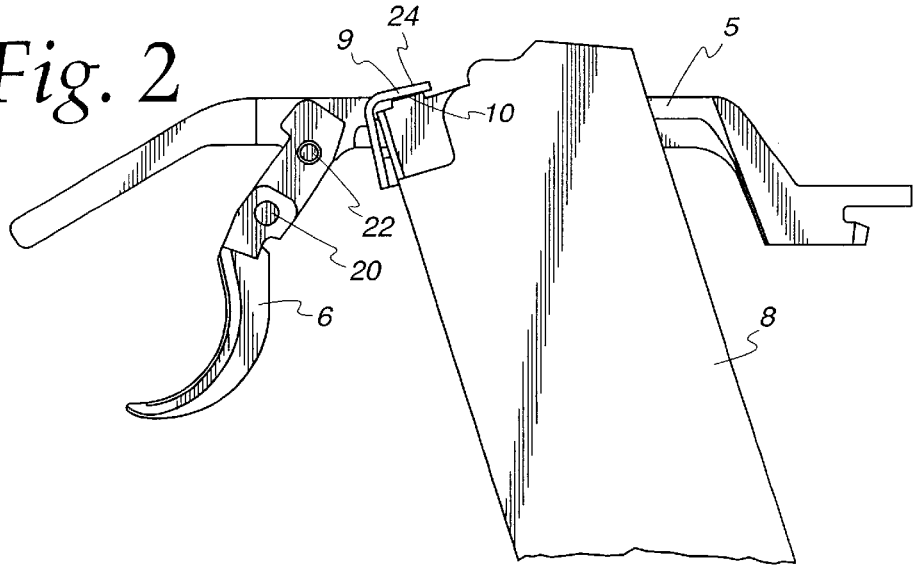
FIG. 2 is a depiction similar to FIG. 1, but with the magazine inserted and with the magazine safety unit in the safety-off condition.

A swiveling lever (2) is positioned under the bar (5) (and, in FIG. 2, covered by the magazine (8)), and is swivelable around a lateral axis firmly anchored in the pistol grip. The swiveling lever (2) has a rear end (3) which pivots in front of a gradation (4) in the bar (5). The lever (2) also has a forward end (9). This forward end (9) is (considered from the plane of FIG. 3), angled out toward the observer, whereby a bar extending transversely to the plane of the diagram is formed. This bar extends upwardly, out from the swiveling lever (2), at approximately a right angle and, at the top, is again angled to the rear at approximately a right angle to form a sensing finger (24).

A pistol grip projection (7) is formed under the rear end (3). A plate spring or a leg spring (1) is located between the projection (7) and the rear part of the lever (2). This spring (1) biases the swiveling lever (2) in a counterclockwise direction, and thereby presses the rear end of the lever (2) in front of the step (4) of the bar (5).

The magazine (8) (FIG. 2) has, on the front side, in front of the magazine lip units, a supporting edge surface (10). The sensing finger (24) of the forward end (9) of the swiveling lever (2) is seated on this surface (10). The front, upwardly-extending part of this forward end (9) engages the forward wall of the magazine (8) to thereby guarantee that the swiveling lever (2) occupies a precise, defined position.

In particular, if no magazine (8) is inserted into the self-loading pistol, then the lever (2) and spring (1) occupy the position shown in FIG. 1. As a result, the rear end (3) of the swiveling lever (2) is swiveled by the force of the spring (1) in front of the step (4) of the bar (5). As a result, the bar (5) is blocked from forward movement. Thus, the trigger (6) cannot be moved (i.e., pulled).

If the person shooting the weapon overlooks the fact that no magazine has been placed in the weapon and wants to shoot, then upon attempting to pull the trigger, he/she will quickly realize that the trigger cannot be moved. Consequently, not only does the shooter automatically secure the weapon by removing the magazine, but he also immediately determines, upon attempting to fire the weapon in a regular manner, that the magazine is missing.

Figure 3:
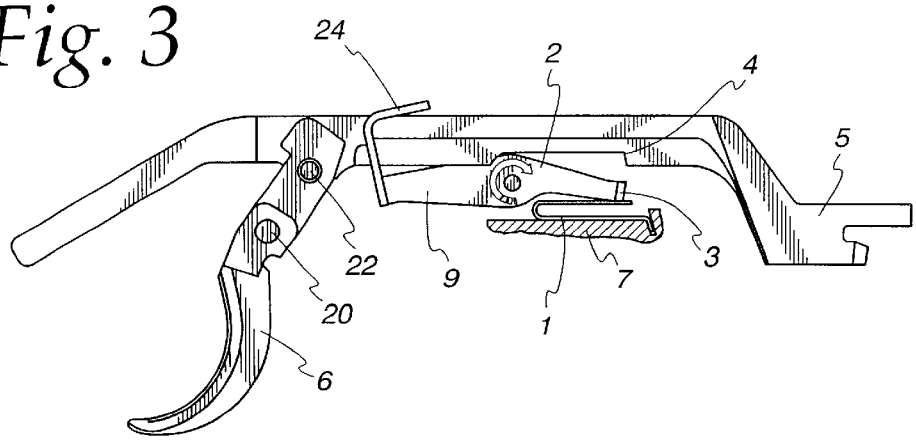
FIG. 3 is the same depiction as in FIG. 2, but without the magazine.

If the magazine (8) is inserted (FIG. 2), then the edge (10) of the magazine (8) engages the sensing finger (24) at the forward end (9) of the swiveling lever (2). This engagement swivels the lever (2) in such a manner that the rear end (3) of the swiveling lever (2) moves away from the projection (4) of the bar (5). Thus, the bar (5) is released for forward movement. The weapon can now be used as usual. This position of the swiveling lever (2) with a magazine (8) fully inserted is depicted in FIG. 3.

In this position, the spring (1) exerts a considerable force on the magazine by way of the swiveling lever (2). This force tends to slide the magazine out of the pistol. If the magazine (8) has not been correctly locked to the firearm, then the force generated by the spring will make the locking failure unambiguously and immediately evident (e.g., the magazine (8) will be ejected).

The leg spring (1) is supported on the surface of the projection (7). Even if this projection is plastic, the surface pressure that it experiences is slight, so that the plastic also reliably withstands this pressure over the passage of time.

Figure 4:
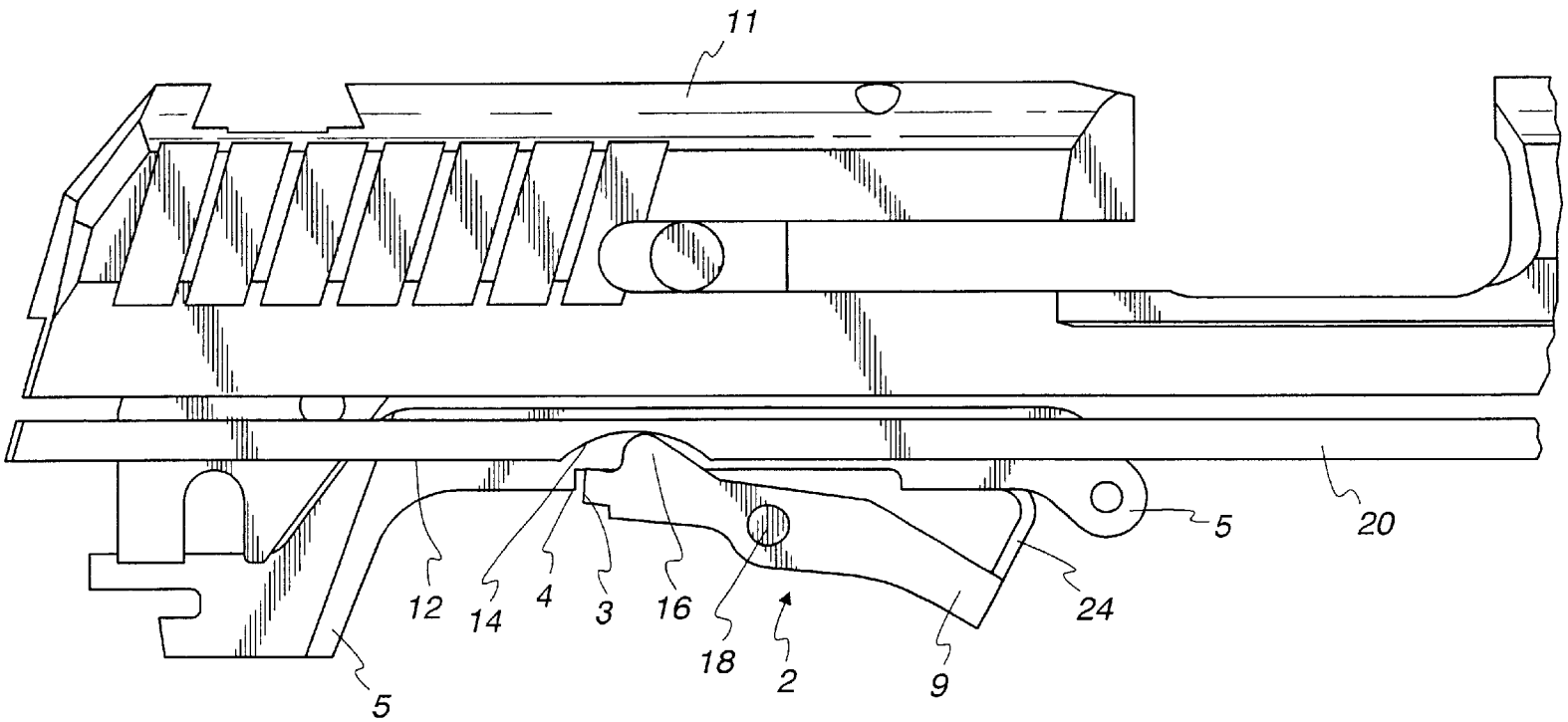
FIG. 4 is a right side view of the sliding support/main part of a firearm in the ready to shoot position, but the triggering bar blocked by another example magazine safety unit since no magazine has been inserted.

Another example magazine safety support cooperating with a sliding support/main part (11) is depicted in FIG. 4. Add-on parts, such as a removal claw, a back sight, or the like have, for the sake of simplicity, been omitted from the example of FIG. 4. The direction of shooting in FIG. 4 is towards the right (right is "forward").

An elongated control part (20) is located below the sliding support (11). In the illustrated example, the control part (20) is separate from and extends in parallel to the longitudinal direction of the sliding support (11), but can also be a longitudinal part of the sliding support (11) which projects downwardly. This longitudinal part (20) has, on its lower side, a control cam (12) with a recess (14). The longitudinal part/control part (20) and/or the control cam (12) extends far enough forward (i.e., to the right in FIG. 4) that, when the sliding support (11) is fully retracted (i.e., moved to its extreme left position in the orientation of FIG. 4), the edge of the control cam (12) is still present at the spot at which the recess is located in FIG. 4.

The pistol grip (not shown) on which the sliding support (11) is guided has a conventional hammer and a trigger (both not shown). The bar (5) extends between these parts as explained in connection with FIGS. 1–3. If the trigger is pulled, then the bar (5) moves forward (to the right in FIG. 4) and, with its rear part, releases the hammer.

A swiveling lever (2) is swivelably mounted around a swiveling axis (18). The rear end (3) of the lever (2) engages in a gradation (4) of the bar (5). The forward end (9) of this swiveling lever (2) supports a sensing finger (24) (more clearly visible in FIG. 2), for the purpose of engaging the upper edge of a magazine (8). If the magazine is slid from below toward the sliding support (11), then it engages the sensing finger (24) to thereby raise the forward end (9) of the swiveling lever (2). The rear end (3) of the lever (2), thus, drops away from the gradation (4) of the bar (5). The bar (5) can now move freely forward and to the rear in its longitudinal direction. If the magazine is removed, then the front end (9) of the swiveling lever (2) moves down, and its rear end engages in the gradation (4). The pistol is now secured. This position is depicted in FIG. 4.

The swiveling lever (2) has on its rear, upper side a cam (16) which engages into the recess (14) if the sliding support (11)/control part (20) is located in its forwardmost position.

Figure 5:
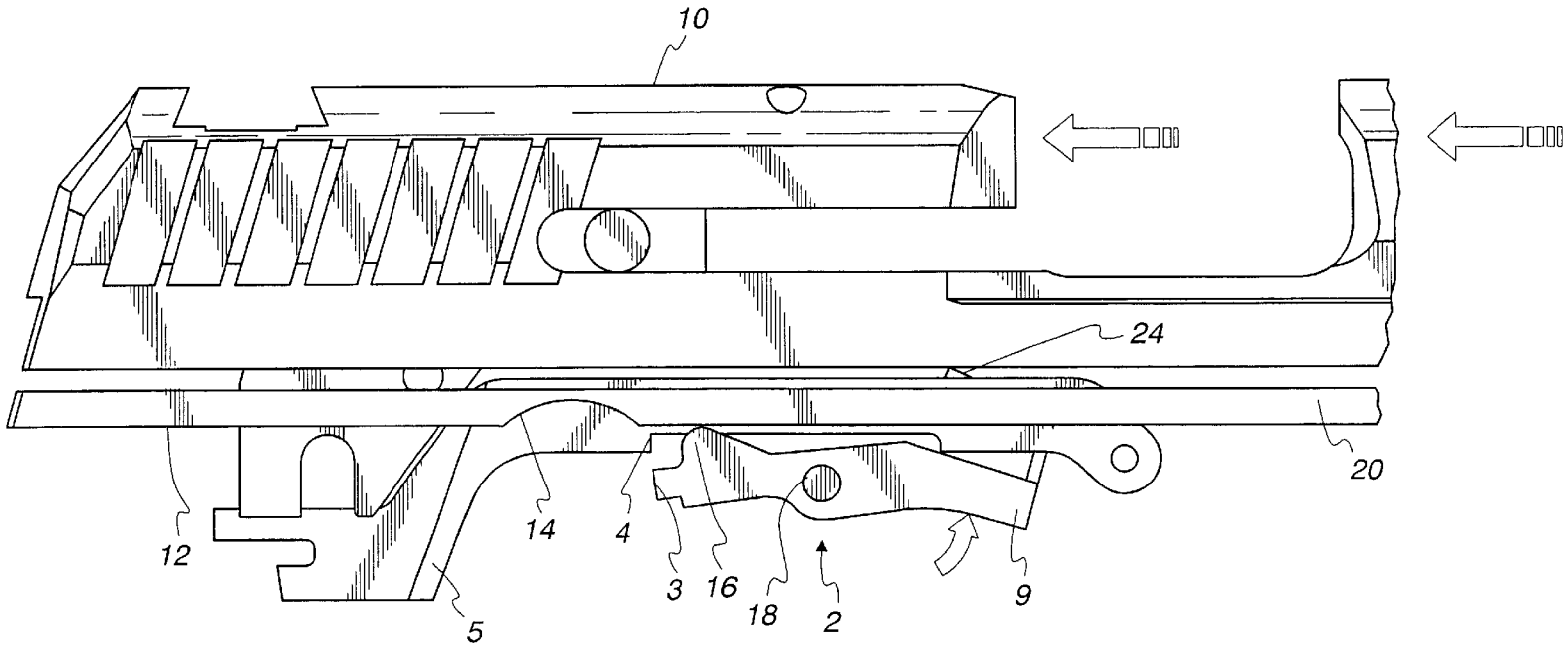
FIG. 5 is a view similar to FIG. 4, but with a sliding support slightly moved back relative to the firearm grip components to permit unloading of the weapon.

If, with the magazine removed, the sliding support (11)/control part (20) is drawn a small distance backwards (i.e., to the left, it cannot move to the right because of the engagement of the lever (2) and the projection surface (4)), then the sliding support (11)/control part (20) moves into a first position in which, because of the construction of the lock parts (not shown), firing of a cartridge is not possible even if the magazine safety unit is missing. The lock parts can be, for example, a recoil lock, or a lock construction of the applicant which is available on the commercial market. This first position is located a short distance in front of a second position in which the sliding support (11) is blocked from reloading by the hammer that has been moved. After leaving the first position, but before reaching the second position, the recess (14) and cam surface (12) press the cam (16) downwardly into a position that corresponds to the position of the inserted magazine (see FIG. 5). The bar (5) is, thus, released, and the weapon can be unloaded. In FIG. 5, the mechanism of the pistol is depicted shortly after passing through the second position. Thus, the disclosed magazine safety unit maintains a lock construction that has proven its value and makes possible the unloading of the weapon with the magazine removed, even though the magazine safety unit is present in the weapon.

From the foregoing, persons of ordinary skill in the art will appreciate that the disclosed magazine safety units prevent forward movement of the bar (5), and thereby also prevent movement of the trigger of the firearm incorporating the safety units when the magazine is removed. The magazine safety units can engage the bar (5) and/or trigger directly or by way of an intermediate element, as long as the intermediate element does not interfere with conveyance of the movements between the trigger and bar (5).

The magazine does not require any modification to cooperate with the magazine safety unit. The swiveling lever (2) engages the upper edge of the magazine (8) and is swiveled by this contact out of engagement with the bar (5) if the magazine is inserted such that the magazine mounting support firmly secures the magazine (8) in a locking manner.

The magazine (8) is, for its part, guided very precisely through the magazine shaft of the self-loading pistol, so that even a narrow edge of the metal sheet forming the magazine wall reliably engages the swiveling lever (2). Moreover, magazines, particularly of heavy pistols, are, for the purpose of reducing weight, manufactured from plastic at the present time. The plastic wall of such magazines is relatively thick. Therefore, a still better support of the swiveling lever (2) is achieved with these plastic magazines.

No particular structures of any type are necessary on the magazine to permit cooperation with the disclosed safety units. Accordingly, a mass produced magazine can be used with the disclosed safety units. That makes the disclosed magazine safety units cheaper than prior art units. However, it is also suitable to construct an opposing seating surface on the magazine to engage the sensing finger (24). Such a surface can be formed very simply.

The swiveling lever (2) is located in the area of the magazine lip units. It is, thus, located in an area of the pistol grip that is covered by the closure or the slide support unit (11). The swiveling axis of the swiveling lever (2) is consequently not accessible after the removal of a pistol stock. In other words, the pistol grip does not require a removable pistol stock. Furthermore, the magazine safety unit, considered from the bottom, is located far enough into the upper end of the magazine shaft that it is very difficult to render the magazine safety unit inoperable by means of a tool. Thus, from a practical standpoint, an unauthorized person cannot shoot the weapon if he does not also have a magazine that fits.

As has already been mentioned above, the magazine (8) has, on the top, front, and side, a corner wherein a cartridge or the bullet in the same is spaced from the inner side of the magazine wall. Preferably, the swiveling lever (2) is positioned at this point in the magazine shaft, since it can cover over the upper edge of the magazine there without causing a disruption of function (e.g., without interfering with loading of the cartridge).

The swiveling lever (2) is preferably positioned laterally in a recess in the pistol grip next to the magazine (8), so that, if the weapon is shaken by the firing of a shot, the lever (2) is additionally supported laterally by the magazine (8). Furthermore, the swiveling lever (2) is located under the bar (5) so that, if the swiveling lever (2) is pressed upwardly on its forward end by the magazine (8), the rear end of the lever (2) swivels downwardly to release the bar (5). The bar (5) includes a projection or a recess (4) on its lower side at a point which is best protected against penetrating dirt.

The swiveling pin (18) of the swiveling lever (2) is seated approximately in the middle of the same, so that a path of engagement is formed in the bar (5) that corresponds approximately to the path of engagement in the magazine. These force and path conditions have turned out to be useful.

The swiveling lever (2) can simply be a smooth sheet metal lever. In order to optimize the guidance of the magazine (8), the illustrated swiveling lever (2) is, on its forward end, angled in such a manner that a tongue (24) is formed. When the magazine (8) is inserted, this tongue (24) engages against the top, forward side of the magazine (8). A smooth application of the magazine (8) to the forward end of the swiveling lever (2) is guaranteed by this configuration. Because of the position of the tongue (24) of the lever (2) and the biasing force of the spring (1), the swiveling lever (2) will not be swiveled, when, for example, the magazine is not inserted. The reliability of the weapon is increased, because the magazine safety unit can be reliably lifted when the magazine (8) is inserted.

At the same time, however, the spring (1) biasing the swiveling lever (2) is reinforced so that, surprisingly enough, it slides the magazine (8) back away from the weapon if the magazine (8) is not locked in place. As a result, a situation in which the magazine (8) slips out from the weapon after the first firing of a shot because the catch of the magazine or the magazine mounting support, has not been secured does not occur. Instead, the spring (1) of the swiveling lever (2) ensures that the person shooting the weapon cannot misinterpret the condition of the weapon in the event that the catch does not engage. On the contrary, only if the magazine (8) is reliably secured into its catch unit will the magazine (8) stay in the weapon. The catch unit is such that, even if inertial forces should appear, such as if the weapon should be dropped, for instance, the magazine is held firm as is conventional.

The swiveling lever (2) is seated either in a lateral groove or above a projection (7) of the casing. A plate spring (1), which presses the rear end of the swiveling lever (2) upwardly and into engagement with the bar (5) if no magazine (8) has been inserted, is mounted between the base of the groove or the projection (7) and the rear part (3) of the swiveling lever (2). This arrangement is simple and reliable in terms of construction. It should be noted that the term "plate spring" includes a wire spring which comprises a bent wire, and, thus, a spring with a circular cross-section as well as springs with rectangular or oval cross-sections.

In the self-loading pistol described above, the fixed hammer permits a small backwards movement of the sliding support (11)/control part (20). After this backwards movement of the sliding support (11), the hammer cannot reach the striking pin and/or the striking pin is blocked in such a manner that it cannot fire. After this slight backwards movement, the swivel lever (2) is moved out from its blocking engagement with the bar (5) while the hammer is blocked from hitting the striking pin and the striking pin cannot fire so that, despite the magazine being removed and with all safety, the hammer can be moved.

With a so-called "recoil lock", for example, after reaching its forwardmost position in which it strikes on the striking pin for the purpose of firing, the hammer is moved independently into a middle position in which it no longer touches the firing pin. The sliding support (11) has a construction which, upon recoil, runs into and cocks the hammer. If the hammer is located in the "middle" position—that is to say, if the trigger has not been activated—then a distance is present between the hammer and the sliding support (11) when the sliding support (11) is located in its forwardmost position. This forwardmost position is the shooting position in which the magazine safety unit must be secured upon the removal of the magazine (8).

If the sliding support (11) is now moved back out of the shooting position, then, after a certain backwards movement, the sliding support (11) occupies a position in which the hammer cannot strike on the firing pin under any circumstances, since it impacts against the sliding support (11) before it touches the firing pin. Then, a cam (12) engages a projection (16) on the lever (2) to lift the lever and thereby disengage the magazine safety unit, even though there is no magazine in the weapon. This state permits unloading of the weapon when a magazine (8) is not present and the safety unit is present.

More specifically, the swiveling lever (2) and the sliding support (11) are directly or indirectly coupled with one another in such a manner that, after the stated backwards movement, the swiveling lever (2) is pivoted out of engagement with the bar (5) by the sliding support (11). Through this pivoting of the swiveling lever (2), the blocking of the bar (5) and, as a result, the blocking of the hammer, is ended.

The pistol can now simply be unloaded with the magazine removed. In other words, during—and only during—the backwards movement of the sliding support (11), the magazine safety unit is deactivated because the pistol is precluded from firing. Shortly before the sliding support (11) returns to its shooting position (e.g., its forwardmost position) and the pistol is made ready to fire again, the magazine safety unit is activated. In other words, if the locking closure returns to its forward position, then the magazine safety unit is engaged again to preclude movement of the trigger.

To this end, a cam (16) is preferably formed on the swiveling lever (2). When the swiveling lever (2) engages the bar (5), this cam (16) is located in an opposing recess (14), which is formed on the sliding support (11) or in anther part (e.g., control part (20)) which is connected or connectable therewith. When the sliding support (11) is in the forwardmost position (e.g., shooting position), the cam (16) lies inside the recess (14). If the sliding support (11) (and thereby the recess (14)) is moved relative to the handle of the weapon (and thereby relative to the cam (16)), then the wall of the recess (14) moves the cam (16), and thereby the swiveling lever (2) (against the force of the spring (1)). This movement presses the swiveling lever (2) toward the upper edge of the magazine shaft. The swiveling lever (2) then occupies (in the no longer entirely closed position and in the open position of the sliding support (11)) exactly the same position it occupies in the presence of an inserted magazine (8). The sensing finger (24), which is formed on the swiveling lever (2) in order to sense the presence of the magazine (8), is accordingly pressed upwardly.

In an example, one end of the swiveling lever (2) is positioned for engagement into a counter-support of the bar (5), while the other end (e.g., the sensing finger (24)) is positioned for engagement with the upper edge of the magazine (8). The ends are positioned on opposite sides of the swiveling axis. The cam (16) is formed close to the first end. The cam (16) is consequently located under the sliding support (11) and penetrates into a recess (14) which is formed in the sliding support (11) or in a control part (20) associated with the sliding support (11). The disassembly of the pistol in the usual manner is still possible, since the parts of the sliding support (11) and the pistol grip do not engage with one another.

Instead of a recoil lock, or in addition to the same, a firing pin safety device which blocks the firing pin if the locking closure is not completely closed and/or an interrupting mechanism which, upon opening, still makes firing impossible without the sliding support (11) being unlocked, can also be present.

Although certain apparatus constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. For use with a firearm having a grip, a sliding support, a magazine shaft, a trigger, a hammer, and a removable magazine, a magazine safety unit comprising:

a bar to operatively connect the trigger and the hammer;

a lever mounted for pivoting movement about a pivot pin; and a spring biasing the lever into engagement with the bar such that, when the lever engages the bar, the bar is prevented from moving in a first direction, the lever being positioned such that, insertion of the magazine into the firearm pivots the lever against a biasing force of the spring and out of engagement with the bar, wherein when the lever is not engaged by the magazine, the sliding support is movable in a second direction, and the sliding support pivots the lever when the sliding support moves in the second direction, such that the lever disengages the bar, so that, despite the magazine being removed from the firearm, the hammer can be moved.

2. A magazine safety unit as defined in claim 1, wherein the lever has an end positioned at least partially in front of the magazine and at least partially above the magazine.

3. A magazine safety unit as defined in claim 1 wherein the lever has an end which extends upwardly to an upper end, and the upper end is bent back over a position to be occupied by the magazine when the magazine is inserted in the firearm.

4. A magazine safety unit as defined in claim 1 wherein the lever is mounted in a groove of the grip.

5. A magazine shaft as defined in claim 1 wherein the lever is mounted near a forward side of the magazine shaft.

6. A magazine safety unit as defined in claim 1 wherein the lever is mounted above a projection located in the magazine shaft, and the spring is positioned below the lever on the projection.

7. A magazine safety unit as defined in claim 1 wherein, when the sliding support is moved a sufficient distance in the second direction, the sliding support prevents the hammer from striking the striking pin.

8. A magazine safety unit as defined in claim 1 wherein, when the sliding support is moved a sufficient distance in the second direction, the striking pin is prevented from firing a cartridge.

9. A magazine safety unit as defined in claim 1, further comprising a cam on the lever, the cam being positioned to engage a recess associated with the sliding support when the lever engages the bar.

10. A magazine safety unit as defined in claim 9 wherein the lever has a first end to engage the bar and a second end to engage the magazine, the cam being located nearer to the second end then to the first end.

11. The magazine safety device of claim 1, wherein:

the lever is mounted for movement between a first position wherein the lever impedes movement of the bar and a second position wherein the lever does not impede movement of the bar; and the spring biases the lever toward the first position, wherein the lever is positioned to be engaged by the magazine such that, insertion of the magazine moves the lever toward the second position.

12. A magazine safety device as defined in claim 11 wherein a spring force associated with the spring pushes the magazine out of the firearm if the magazine is not secured to the firearm.

13. A magazine safety device as defined in claim 11 further comprising:

a cam carried by the lever, the cam being received in a recess associated with the sliding support when the lever is in the first position, the cam and recess cooperating to move the lever from the first position to the second position when the sliding support is moved in a first direction and the magazine is removed from the weapon.

14. A firearm having a trigger and a removable magazine comprising:

a sliding support; and a magazine safety unit according to claim 1.

15. A firearm as defined in claim 14 wherein the magazine safety unit is disengaged by moving the sliding support in a rearward direction relative to the firearm when the magazine is removed from the weapon.

16. A firearm as defined in claim 15 wherein the magazine safety unit is disengaged by inserting the magazine into the firearm.

17. A method of operating a firearm having a sliding support, a trigger, a hammer, a removable magazine, and a magazine safety unit according to claim 1, said method comprising:

in response to removal of a magazine from the firearm, securing the bar to preclude movement of the bar;

if the magazine is inserted into the firearm, releasing the bar for movement; and if the magazine is not present in the firearm and the sliding support is moved a predetermined distance releasing the bar for movement to facilitate unloading of the weapon when the magazine is not inserted in the firearm.

* * * * *